US005718637A

United States Patent [19]

Rodriguezx-Ferré

[11] Patent Number: 5,718,637

[45] Date of Patent: Feb. 17, 1998

[54] COMPOSITE SLIDE FOR CHILDREN TO USE

[76] Inventor: José Manual Rodriguezx-Ferré, Poligono Industrial Derramador -c/. Albacete s/n, 034404-IBI (Alicante), Spain

[21] Appl. No.: 699,795

[22] Filed: Aug. 19, 1996

[30] Foreign Application Priority Data

Oct. 4, 1995 [ES] Spain ..... 9502538 U

[51] Int. Cl.[6] ..... A63G 21/04

[52] U.S. Cl. ..... 472/116; 472/117

[58] Field of Search ..... 472/116, 117, 472/88; 482/35

[56] References Cited

U.S. PATENT DOCUMENTS 5,453,055 9/1995 Van Huystee ..... 472/116

*Primary Examiner*—Kien T. Nguyen

*Attorney, Agent, or Firm*—Lackenbach Siegel Marzullo Aronson & Greenspan, PC

[57] ABSTRACT

Improved composite slide for children having two pairs of modular parts (1) and (2) and a single part (3) made of a molded material. Parts (1) are parallel and inclined, forming the sides of the slide, and are interconnected by parts (2) through a conjugated connection existing in both; and parts (2) form the rungs leading to the upper portion of the single part (3), which makes up the slide as such, the upper portion being linked to the upper areas of the sides, through the conjugated connection integrated therein.

2 Claims, 1 Drawing Sheet

COMPOSITE SLIDE FOR CHILDREN TO USE

The present invention relates to an improved composite slide for children to use.

The object of the invention specifically consists of a slide to be used by very young children as a plaything. The slide is of the kind which comprises a plurality of moulded material parts, including connecting means made at the moulding stage proper and integrated in said parts, with which the slide can be composed into a solid and perfectly stable structure, ensuring playing safety. It is quick and simple to mount, requiring no implements, special tools or any joining element other than the parts of the toy. This organisation allows the parts to be stored in a minimum space when the toy is not in use, and its assembly in due course.

Broadly speaking, the slide proposed herein consists of two pairs of modular parts which altogether conform a ladder leading up to the upper portion of the slide as such, comprised by a single part. The ladder and the slide make up a sort of trestle of variable angular aperture, depending upon the desired slope of the slide track, the aperture being fixed by suitable means inherent in the parts.

For ease of explanation, attached hereto is a sheet of drawings where an embodiment cited as an example has been represented.

Figure 1:
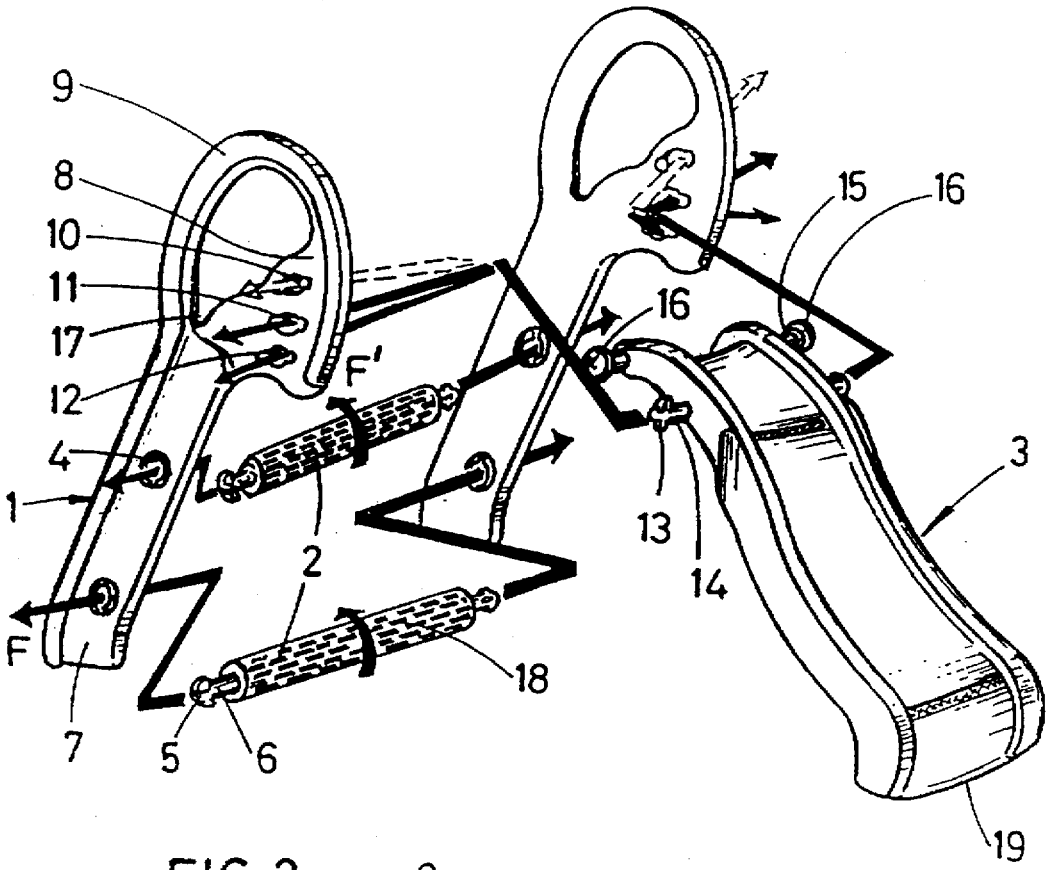
FIG. 1 is a perspective exploded view of the slide.
Figure 2:
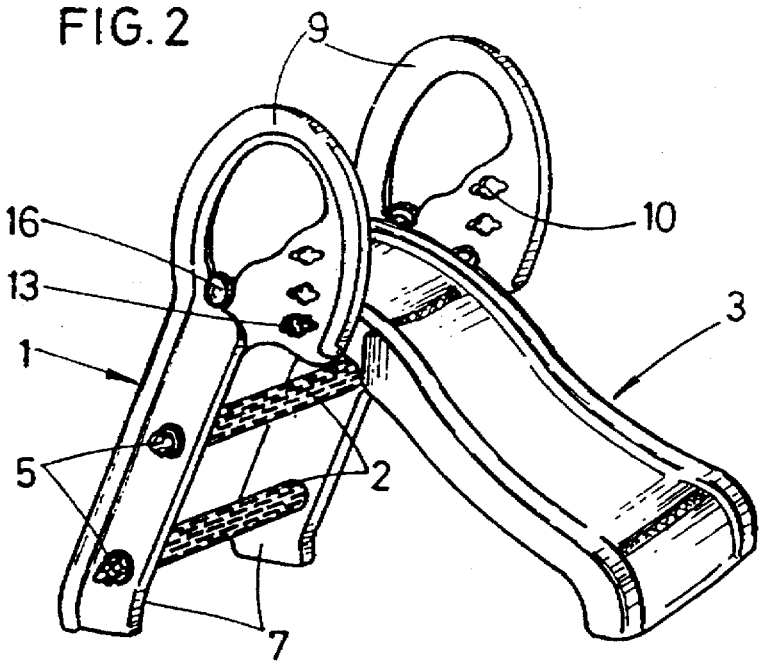
FIG. 2 is a perspective of the assembled slide, ready to be used.

With reference to the figures, the embodiment shows a composite slide to be used by very young children, who are preferably aged between two and seven, characterised by consisting of pairs of modular parts, numbered -1- and -2-, and a single part, numbered -3-. Parts -1- and -2-together make up a ladder, the sides being formed by said parts -1- whereas the rungs are comprised by parts -2-. The side parts -1- have slots -4- for the insertion of T-shaped heads -5- lying at the ends of two axial shafts -6- of the rungs -2-, which T-shaped heads are inserted in the slots -4- in a direction F and are then turned in a direction F' to establish a solid connection with the sides -1-, making up the ladder and with said rungs -2-lying in their functional position, affording a maximum bearing surface, determined by their elliptical section. Said sides -1- are formed by substantially flattened parts having a substantial bend -7- at their bottom end to be supported on the ground, whereas their top end conforms an extension or enlargement -8- provided with a hole which constitutes the balustrade-handrail -9-, which extensions respectively include three slotted openings -10-, -11- and -12- lying at a different height, for a -selective anchorage of T-shaped heads -13- lying at the ends of shafts -14- projecting from the upper portion of the sides of the slide constituted by part -3-.

Necks -15- ending in circular heads -16- are provided on both sides at the top end of such part -3-, which necks lie on two curvo-convex seats -17- serving as a bearing. This organisation allows the slide to turn about the supports -15-, -17- in order that the slope of the slide -3- may be altered, locating the heads -13- in the various anchorages -10-, -11- and -12-.

The surface of the rungs -2- has non-slip ridges.

The bend -7- on the sides -1- making up the ladder and the bend -19- at the bottom end of the slide -3- stand as stable supports for the structure, which keeps the child safe during playtime.

I claim:

1. An improved composite slide, comprising: pairs of modular side parts (1) and rungs (2) and a single part (3) made of a molded material, said modular side parts (1) being elongate and substantially flattened in shape, with straight, parallel longitudinal sides, and each having a lower end with a bend (7) for oblique support, whereas each top end thereof comprises a material extension (8) having a curvo-convex edge, including an aperture making up a balustrade-handrail (9), and each said straight longitudinal side has a pair of diametrically slotted holes (4) for receiving and retaining two T-shaped heads (5) of shafts (6) coaxial with said rungs (2) and said shafts (6) are elongate elements having an elliptical section and a non-slip surface, and said T-shaped heads (5) and said slotted holes (4) establishing a solid connection by means of a quarter turn rotation of said rungs (2), whereby a ladder structure is formed in which said modular side parts (1) form the sides and the balustrade-handrail, and whereas each said rung (2) provides a maximum supporting surface in the functional position due to said elliptical section.

2. An improved composite slide, according to claim 1, wherein said single part (3) is a slide having an upper top portion linked to said extensions (8) of said modular side parts (1) by means of an articulated support which forms a trestle-like structure of variable angle, and said articulated support is formed by the combination of hinge pins (15) of said slide and a pair of semi-circular seats (17) provided in said apertures of said extensions (8), and said slide (3) being capable of a desired slope, which is selectable by using one of a plurality of anchorages (10), (11) and (12) in said extensions (8), each in the form of diametrically slotted openings mateable in a locked manner with shafts (14) having a T-shaped head (13) disposed on both sides of said upper top portion of said slide, close to said hinge pins (15) seated in said semi-circular seats (17) serving as bearing surfaces for said hinge pins (15).

* * * * *

UNITED STATES PATENT AND TRADEMARK OFFICE

CERTIFICATE OF CORRECTION

PATENT NO. : 5,718,637

DATED : Feb. 17, 1998

INVENTOR(S) : Jose Manual Rodriguez-Ferre

It is certified that error appears in the above-identified patent and that said Letters Patent is hereby corrected as shown below:

On title page, item [19],
change the name listed for the inventor from "Rodriguezx-Ferré" to --Rodriguez-Ferre--.

On Item [76] also change the same name from "Rodriguezx-Ferré" to --Rodriguez-Ferré--.

Signed and Sealed this

Fifth Day of October, 1999

*Attest:*

*Attesting Officer*

Q. TODD DICKINSON

*Acting Commissioner of Patents and Trademarks*